US008381808B2

(12) United States Patent
Rogers et al.

(10) Patent No.: US 8,381,808 B2
(45) Date of Patent: Feb. 26, 2013

(54) CEMENT HEAD

(75) Inventors: Henry E. Rogers, Duncan, OK (US); Phillip Standifer, Duncan, OK (US); Brett A. Fears, Duncan, OK (US); John T. Deville, Ville Platte, LA (US)

(73) Assignee: Halliburton Energy Services, Inc., Duncan, OK (US)

( * ) Notice: Subject to any disclaimer, the term of this patent is extended or adjusted under 35 U.S.C. 154(b) by 429 days.

(21) Appl. No.: 12/260,746

(22) Filed: Oct. 29, 2008

(65) Prior Publication Data

US 2010/0101792 A1 Apr. 29, 2010

(51) Int. Cl.
*E21B 33/05* (2006.01)

(52) U.S. Cl. ..... 166/70

(58) Field of Classification Search ..... 166/285, 166/70, 378; 285/81, 86, 91, 90, 403, 404
See application file for complete search history.

(56) References Cited

U.S. PATENT DOCUMENTS

| | | | | |
|---|---|---|---|---|
| 1,662,311 | A * | 3/1928 | Hamer | 166/70 |
| 3,198,555 | A * | 8/1965 | Johnson et al. | 285/91 |
| 3,926,253 | A * | 12/1975 | Duke | 166/75.15 |
| 3,951,208 | A * | 4/1976 | Delano | 166/78.1 |
| 4,159,132 | A * | 6/1979 | Hitz | 285/39 |
| 4,524,998 | A * | 6/1985 | Brisco | 285/101 |
| 5,152,554 | A | 10/1992 | LaFleur et al. | |
| 5,441,310 | A * | 8/1995 | Barrett et al. | 285/18 |
| 5,443,122 | A | 8/1995 | Brisco | |
| 5,950,724 | A | 9/1999 | Giebeler | |
| 6,575,238 | B1 | 6/2003 | Yokley | |
| 6,634,423 | B2 | 10/2003 | Giebeler et al. | |
| 6,904,970 | B2 * | 6/2005 | Simson | 166/291 |

(Continued)

FOREIGN PATENT DOCUMENTS

| | | |
|---|---|---|
| EP | 0500165 A1 | 8/1992 |
| GB | 2404210 A | 1/2005 |

OTHER PUBLICATIONS

Foreign communication from a related counterpart application—International Search Report and Written Opinion, PCT/GB2009/002264, Jan. 28, 2010, 8 pages.

(Continued)

*Primary Examiner* — Nicole Coy
(74) *Attorney, Agent, or Firm* — John Wustenberg; Conley Rose, P.C.

(57) ABSTRACT

A cement head, comprising a first module comprising a first module outer profile, a second module comprising a second module outer profile, a bridge comprising a bridge profile engaged with each of the first module outer profile and the second module outer profile. A wellbore servicing apparatus, comprising a first module coaxial with a central axis, the first module comprising a first module outer surface, and a plurality of first module protrusions extending radially outward from the first module outer surface, a second module coaxial with the central axis, the second module comprising a second module outer surface, and a plurality of second module protrusions extending radially outward from the second module outer surface, a bridge having an outer bridge surface and an inner bridge surface, the bridge inner surface substantially complementing each of the first module outer surface, including the plurality of first module projections, and the second module outer surface, including the plurality of second module projections, when the first module is substantially adjacent the second module and a bridge outer surface, and a retainer coaxial with the central axis and configured to substantially radially retain the bridge toward the central axis with respect to each of the first module outer surface and the second module outer surface.

33 Claims, 13 Drawing Sheets

U.S. PATENT DOCUMENTS

| | | | | |
|---|---|---|---|---|
| 7,066,249 | B2 | 6/2006 | Simson | |
| 7,237,626 | B2 | 7/2007 | Gurjar et al. | |
| 7,249,632 | B2 | 7/2007 | Robichaux et al. | |
| 2004/0055741 | A1 * | 3/2004 | Pedersen et al. | 166/70 |

OTHER PUBLICATIONS

Hybrid Technology Brochure, "Top Drive Universal Lifting Cement Head System," 4 pages, Hybrid Technology.

Smith Services Product Bulletin, SS08-3014, "Top Drive Internal Bypass Cementing Manifold," 2007, 1 page, Smith International, Inc.

Smith Services Product Details, "Top Drive Cementing Manifold," 2008, http://siismithservices.com/b_products/product_page.asp?ID=133, 3 pages, Smith International, Inc.

Weatherford Completion Systems Information Sheet, "TDH Top Drive Cementing Head," 2000, 1 page, Weatherford.

* cited by examiner

CEMENT HEAD

CROSS-REFERENCE TO RELATED APPLICATIONS

Not applicable

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

Embodiments described herein relate to wellbore servicing tools and wellbore servicing equipment.

BACKGROUND

Wellbore servicing tools and equipment are often configured for inline assembly along a work string or other elongate fluid conduit. Wellbore servicing tools are designed to comprise many different methods of assembling the tools and/or connecting the tools to other wellbore servicing equipment. A common method of assembling a wellbore servicing tool is to use a threaded connection or other connection that requires relative rotation between a first piece of the tool and a second piece of the tool, or alternatively, relative rotation between the tool and other wellbore servicing equipment to be connected to the tool. One reason the relative rotation can be an especially undesirable requirement for assembling and/or installing a wellbore servicing tool is that extra rotary-capable equipment is often necessary to provide the rotation and that extra rotary-capable equipment is often bulky and/or expensive. Further, while some wellbore servicing tools may be assembled and/or installed using the rotary-capable equipment in the primary work string area, it is generally not economically desirable or a good safety practice to perform such tool assembly in the primary work string area. Further, since the wellbore servicing tools are often large, heavy, and/or otherwise inconvenient for rotating, there exists a need for providing wellbore servicing tools and wellbore servicing equipment that can be assembled and/or installed without the need to provide the above-described relative rotation. Likewise, there is a need for a wellbore servicing tool that can be assembled away from the primary work string area without the need to provide the above-described relative rotation, thereby avoiding the need to provide extra rotary-capable equipment at a location other than the primary work string area.

SUMMARY

Disclosed herein is a cement head, comprising a first module comprising a first module outer profile, a second module comprising a second module outer profile, a bridge comprising a bridge profile engaged with each of the first module outer profile and the second module outer profile.

Also disclosed herein is a wellbore servicing apparatus, comprising a first module coaxial with a central axis, the first module comprising a first module outer surface, and a plurality of first module protrusions extending radially outward from the first module outer surface, a second module coaxial with the central axis, the second module comprising a second module outer surface, and a plurality of second module protrusions extending radially outward from the second module outer surface, a bridge having an outer bridge surface and an inner bridge surface, the bridge inner surface substantially complementing each of the first module outer surface, including the plurality of first module projections, and the second module outer surface, including the plurality of second module projections, when the first module is substantially adjacent the second module and a bridge outer surface, and a retainer coaxial with the central axis and configured to substantially radially retain the bridge toward the central axis with respect to each of the first module outer surface and the second module outer surface.

Further disclosed herein is a wellbore servicing apparatus, comprising a first module comprising a first module outer profile, a second module comprising a second module outer profile, a bridge comprising a bridge profile engaged with each of the first module outer profile and the second module outer profile.

Further disclosed herein is a method of assembling a wellbore servicing tool, comprising placing a first module adjacent to a second module along an axis, engaging a bridge with each of the first module and the second module by, while the bridge radially overlaps one of the first module and second module, substantially restricting movement of the bridge to movement radially toward the first module and the second module and toward the axis.

Further disclosed herein is a method of assembling a wellbore servicing tool, comprising angularly aligning a first module with a second module, joining the first module to the second module while maintaining the angular alignment between first module and the second module.

Further disclosed herein is a method of servicing a wellbore, comprising assembling a cement head without using torque to join components of the cement head, and passing a fluid through the cement head into a wellbore.

Further disclosed herein is a method of assembling a cement head, comprising joining a first module of the cement head to a second module of the cement head without using torque.

BRIEF DESCRIPTION OF THE DRAWINGS

For a more complete understanding of the present disclosure, and for further details and advantages thereof, reference is now made to the accompanying drawings, wherein.

DETAILED DESCRIPTION OF THE INVENTION

Figure 1:
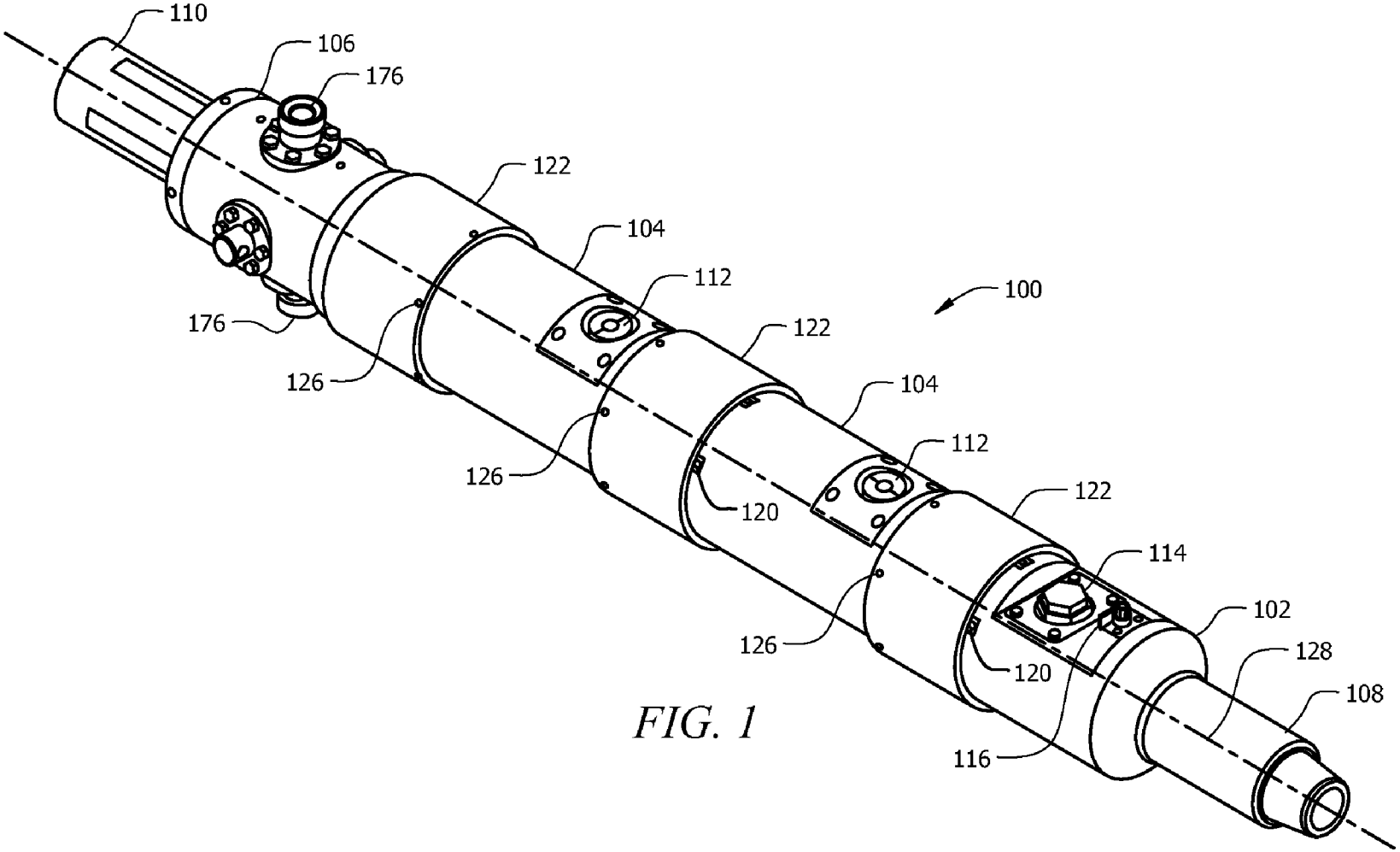
FIG. 1 is an oblique view of a cement head according to an embodiment.
Figure 2:
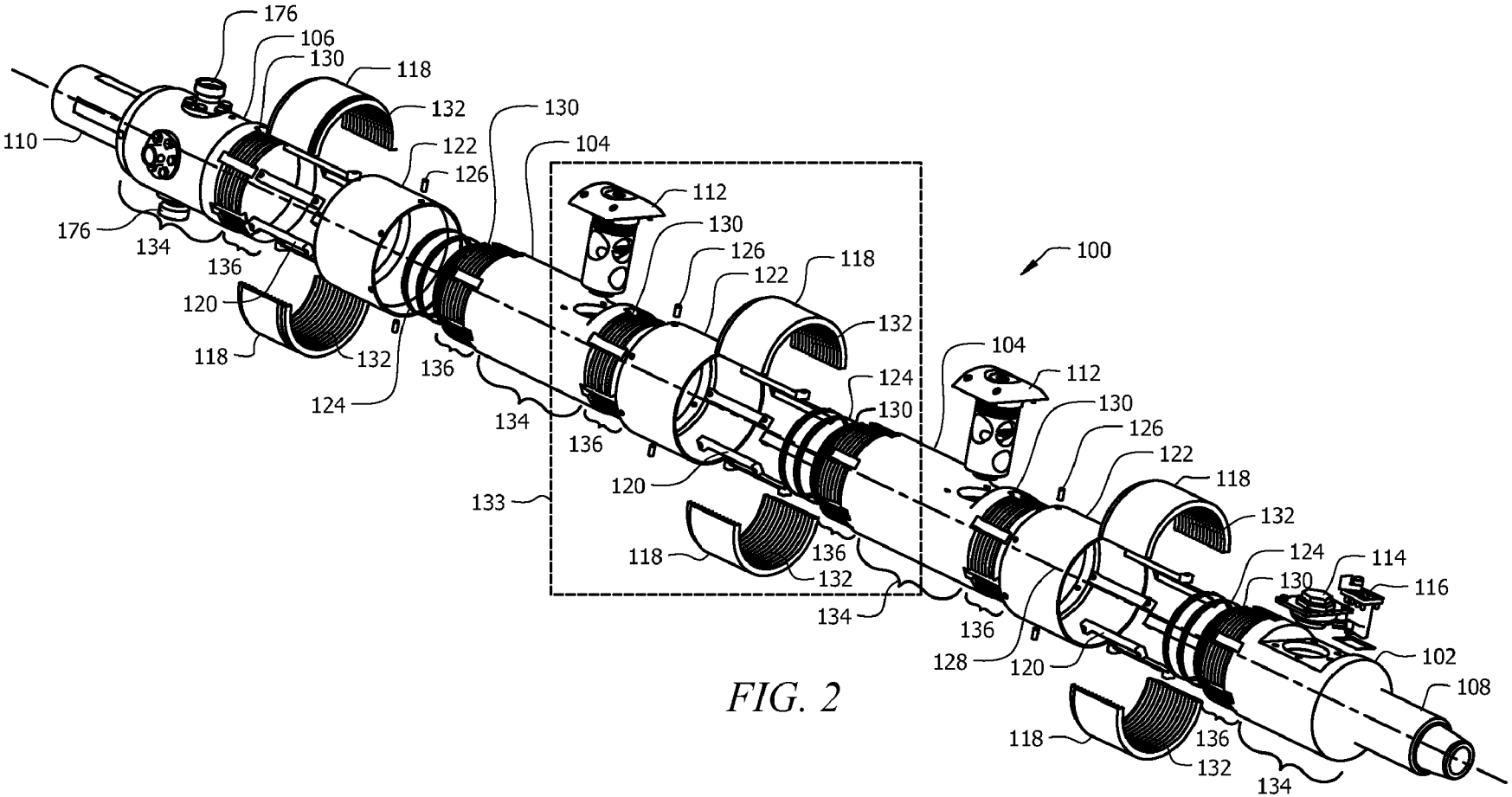
FIG. 2 is an oblique exploded view of the cement head of FIG. 1.
Figure 3:
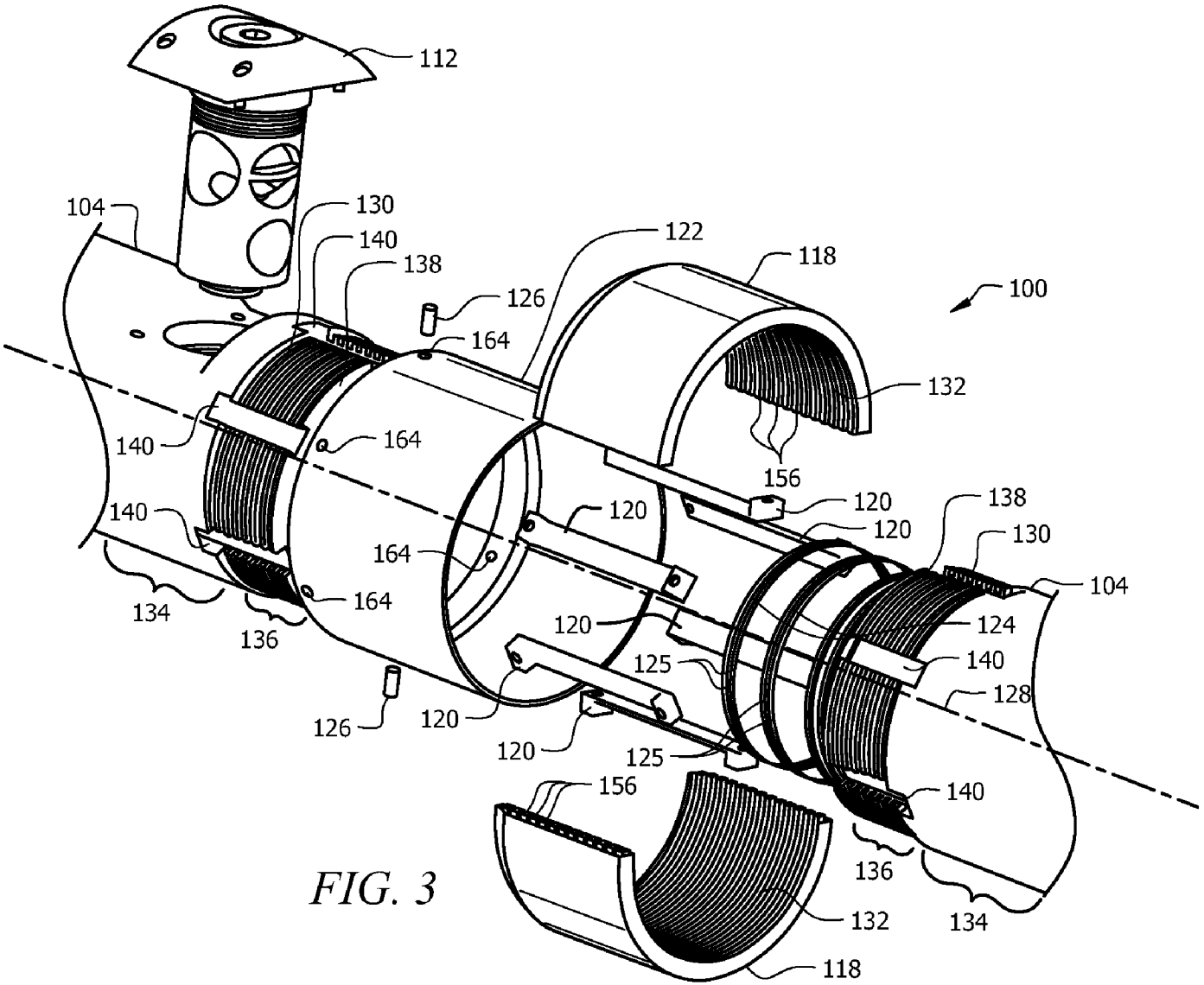
FIG. 3 is an oblique exploded view of a portion of the cement head of FIG. 1.

Referring now to FIGS. 1-3, a cement head 100 according to an embodiment is shown. Cement head 100 is generally a multi-function device for use inline with a work string associated with a wellbore in a hydrocarbon fluid production well. Most generally, the cement head 100 is used to deliver cement or other wellbore servicing fluids and/or mixtures to a wellbore through the work string to which the cement head 100 is attached. The cement head 100 is also capable of delivering darts and/or balls for activating or initiating some function of a tool or structure associated with the work string. The cement head 100 comprises an output module 102, two intermediate modules 104, and an input module 106. Each of the output module 102, intermediate modules 104, and input module 106 have a substantially cylindrical outer profile and each lie substantially coaxial with a central axis 128 that extends generally along the length of the cement head 100 and is generally located centrally within cross-sections of the cement head 100 that are taken orthogonal to the central axis 128. Each intermediate module 104 comprises a launch valve 112 (discussed infra) while the output module 102 comprises a launch port 114 and a launch indicator 116 (each discussed infra).

Considering that the cement head 100 as a whole must withstand enormous tensile forces along the length of the cement head 100, the high tensile forces generally being attributable to the overall weight of the work string that is connected to the cement head 100 below the output module 102, the connections between the output module 102, intermediate modules 104, and input module 106 must be robust. Such robust connections are accomplished using bridges 118, keys 120, retainers 122, seals 124, and lock screws 126, in combination with structural features of the output module 102, intermediate modules 104, and input module 106 themselves. The output module 102, intermediate modules 104, and input module 106 comprise primary outer profiles 130 that interact with bridges 118 to aid in forming the connections between the modules 102, 104, 106. Particularly, the primary outer profiles 130 interact with complementary profiles 132 of bridges 118 which help transfer tensile forces between adjacent modules 102, 104, 106. Further, keys 120 are used to prevent relative rotation between adjacent modules 102, 104, 106 while also transferring torque between adjacent modules 102, 104, 106. Finally, retainers 122 are used to guarantee continued interaction between the primary outer profiles 130 and the complementary profiles 132 while lock screws 126 aid in securing the retainers 122 relative to the bridges 118. Of course, in alternative embodiments, any other suitable device or method may be used to secure the retainers relative to the bridges. A portion of the cement head 100 is illustrated as being bounded by a box 133. The portion of the cement head 100 bounded by the box 133 is shown in greater detail as FIG. 3.

Figure 12:
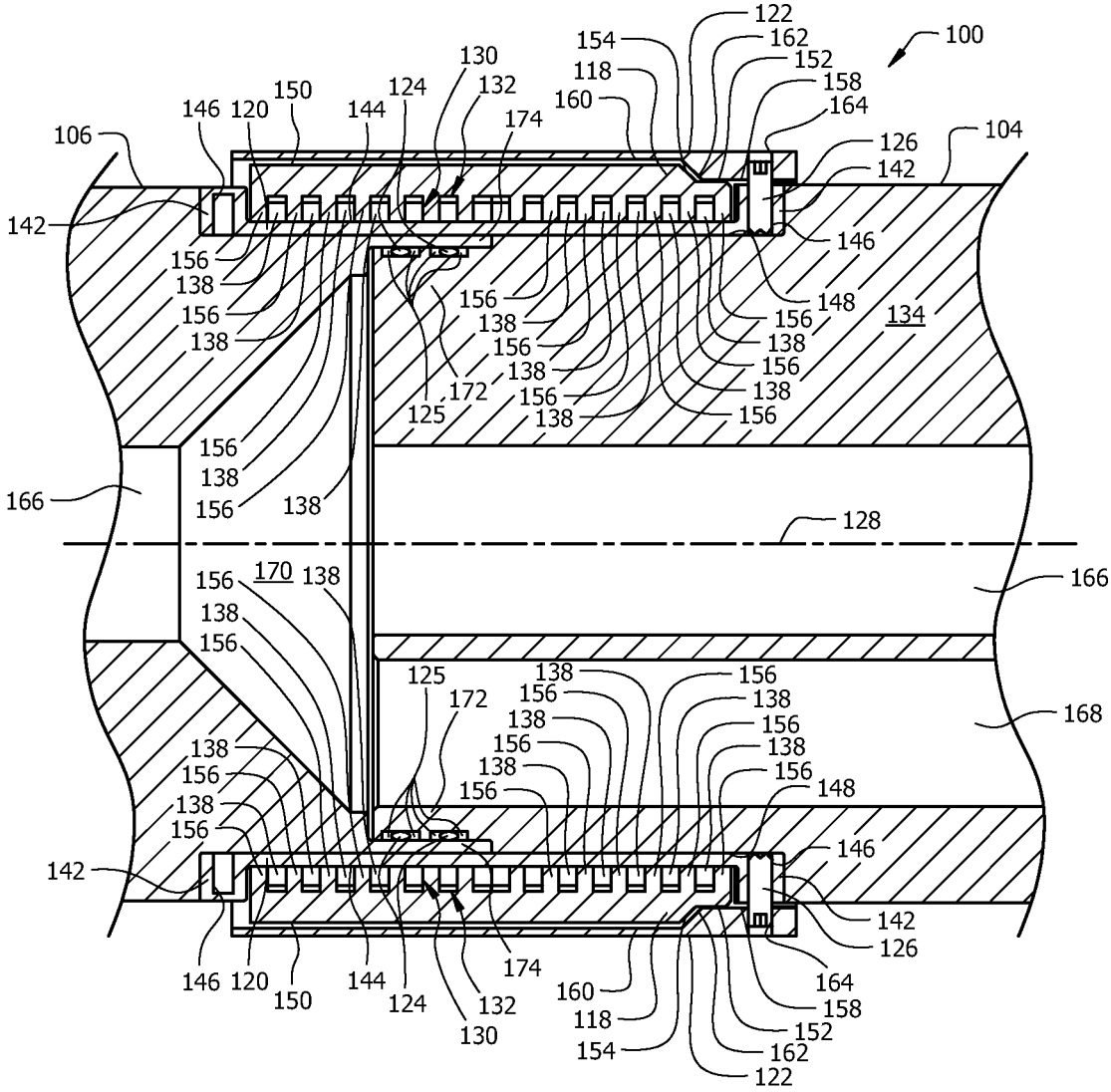
FIG. 12 is an orthogonal cross-sectional view of a portion of the cement head of FIG. 1.

FIG. 3 shows a portion of the cement head 100 in greater detail. Specifically, FIG. 3 is an exploded view showing the portion of the cement head 100 where the two intermediate modules 104 are adjacent. This view is particularly helpful in showing details of the primary outer profiles 130 of the intermediate modules 104. In this embodiment of a cement head 100, the primary outer profiles 130 of the output module 102 and the input module 106 are essentially the same as the primary outer profiles 130 of the intermediate modules 104. To more easily explain the primary outer profiles 130, the modules 102, 104, 106 may be explained as having full diameter sections 134 joined to reduced diameter sections 136. The reduced diameter sections 136 are lengthwise portions of the modules 102, 104, 106 that are located near and abut with adjacent modules 102, 104, 106 as shown in FIGS. 2 and 3. The intermediate modules 104 comprise two reduced diameter sections 136 joined by a single full diameter section 134. In this embodiment, the full diameter sections 134 among the various modules 102, 104, 106 generally comprise the same outer diameter while the reduced diameter sections 136 generally comprise the same outer diameter. The outer diameter of the full diameter sections 134 is greater than the outer diameter of the reduced diameter sections 136. Still referring to FIG. 3, it is clear that while the full diameter sections 134 have generally smooth outer profiles, the reduced diameter sections 136 comprise protrusions 138 that extend radially away from the central axis 128 and are longitudinally offset from each other along the central axis 128. More specifically, the protrusions 138 are shaped as annular rings that, when viewed in a cross-section taken through the central axis 128, appear as rectangular protrusions extending from the outer diameters of the reduced diameter sections 136 and away from the central axis 128. (see also FIGS. 12 and 13). Taken together, the protrusions 138 of a reduced diameter section 136 form a series of offset ridges. In this embodiment, each protrusion 138 is separated into a plurality of discrete angular segments about the central axis 128 by slots 140. Slots 140 are substantially formed as rectangular recesses that extend longitudinally along the length of the modules 102, 104, 106 from the free ends of the reduced diameter sections 136 into the full diameter sections 134. The slots 140 also extend radially inward from the outermost surfaces of the reduced diameter sections 136 and full diameter sections 134 toward the central axis 128, thereby providing an inward depth to the slots 140. (see also FIGS. 12 and 13).

Figure 4:
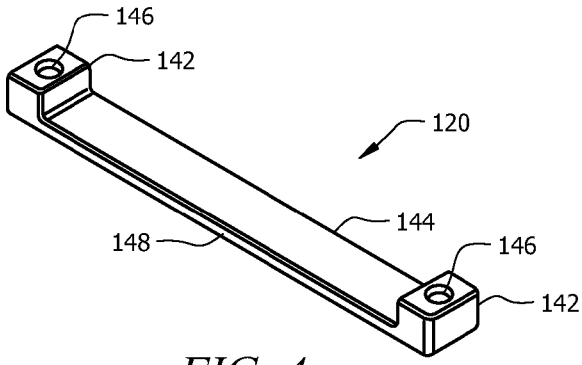
FIG. 4 is an oblique view of an key of the cement head of FIG. 1.
Figure 5:
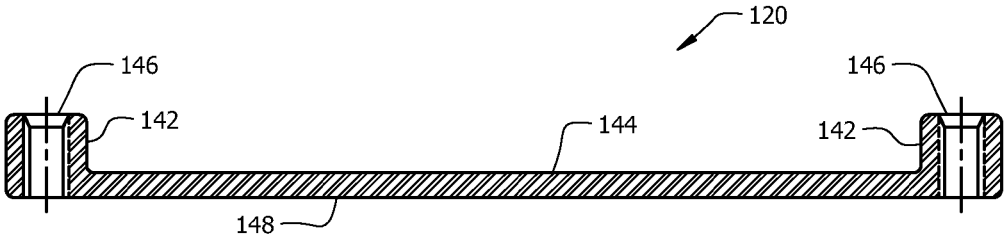
FIG. 5 is an orthogonal cross-sectional view of the key of FIG. 4.

Referring now to FIGS. 4 and 5 (and FIGS. 12 and 13), a key 120 is shown in greater detail. Key 120 comprises two end blocks 142 joined by a central plate 144. Together, the end blocks 142 and the plate 144 provide a slot contact surface 148 for facing the central axis 128 and being seated within a slot 140. When properly installed within a slot 140, one of the end blocks 142 of the key 120 abuts against a wall of a full diameter section. A key aperture 146 is formed through each end block 142 so that when the key 120 is properly installed within a slot 140, the key aperture 146 generally extends toward the central axis 128. In this embodiment, the end blocks 142 extend further radially away from the slot contact surface 148 than the plate 144 when the key 120 is properly installed within a slot 140, the proper orientation of which is shown in FIGS. 1 and 3. While not shown in this embodiment, alternative embodiments may incorporate a matched key and respective matched slot. The matched key and respective matched slot would serve to ensure that a particular rotational orientation between adjacent modules 102, 104, 106 is achieved since only the matched key can fit into the matched slot while all other keys and slots are of a different size and/or shape than the matched keys and matched slots. For example, in an alternative embodiment having matched keys and slots, the matched key may be wider than the remaining keys so that the wider key only fits in a wider slot (the matched slot), thereby ensuring proper rotational orientation between adjacent modules.

Figure 6:
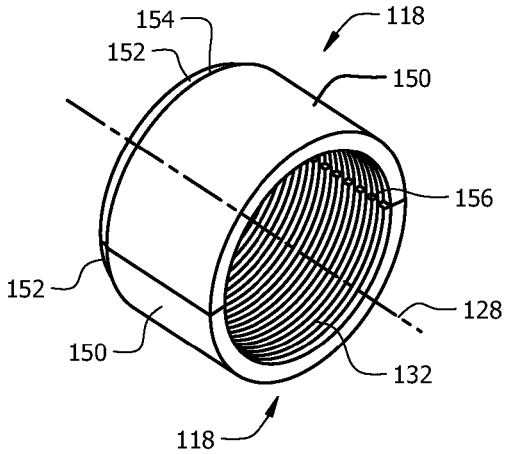
FIG. 6 is an oblique view of a bridge of the cement head of FIG. 1.
Figure 7:
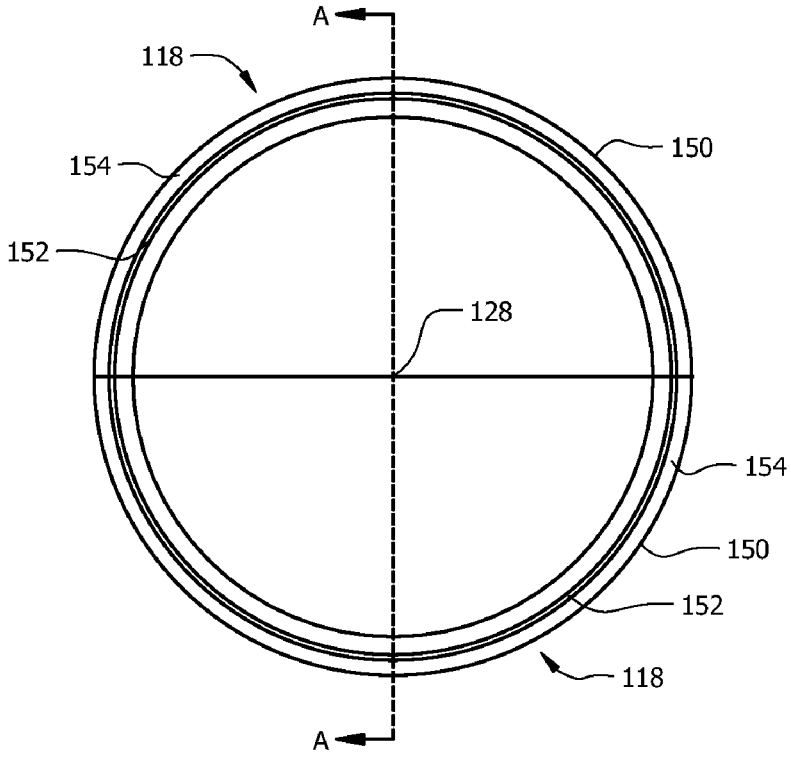
FIG. 7 is an orthogonal end view of the bridge of FIG. 6.
Figure 8:
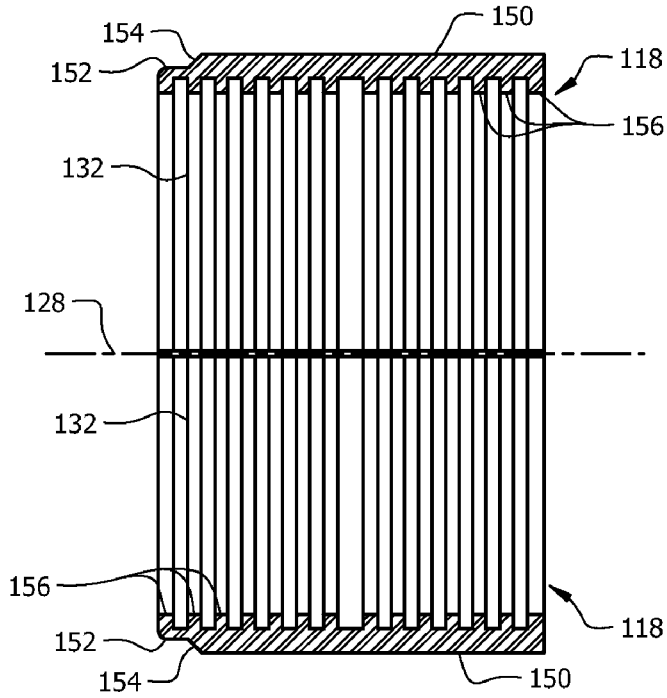
FIG. 8 is an orthogonal cross-sectional view of the bridge of FIG. 7.

Referring now to FIGS. 6-8 (and FIGS. 12 and 13), two bridges 118 are shown in greater detail. Each bridge 118 shown comprises generally the same features and the bridges 118 are illustrated as having substantially similar structure. In this embodiment, each bridge 118 generally is formed as a cylindrical tubular half-shell having some additional structural features. In other words, and as shown in FIGS. 6 and 7, when two bridges 118 are located adjacent each other in a properly installed orientation, the two bridges 118, together, substantially form a cylindrical tubular member. Each bridge 118 comprises an outermost surface 150 that, in this embodiment, is a cylindrical surface. Each bridge 118 further comprises a reduced outer surface 152, a cylindrical surface having a smaller diameter than the outermost surface 150, joined to the outermost surface by a bevel 154. As previously discussed, the bridges further comprise complementary profiles 132. The complementary profiles 132 comprise complementary protrusions 156. The complementary protrusions 156 extend radially toward the central axis 128 and are longitudinally offset from each other along the central axis 128. More specifically, the complementary protrusions 156 are shaped as annular rings that, when viewed in a cross-section taken through the central axis 128, appear as rectangular protrusions extending from the inner diameter of the bridge 118, toward the central axis 128. Taken together, the complementary protrusions 156 of the bridge 118 form a series of offset ridges. The complementary profiles 132 and complementary protrusions 156 are termed such because, at least generally, their shape and size complements the respective primary outer profiles 130 and protrusions 138. More specifically, the complementary profiles 132 complement the primary outer profiles 130 so that tensile forces generally parallel to the central axis 128 are sufficiently transferred between adjacent modules 102, 104, 106 through bridges 118. Generally, the profiles 130, 132 complement each other so that a tolerance between the protrusions 138, 156 when the cement head 100 is fully assembled is, in this embodiment, approximately equal to about the same thread tolerance as a Type 1 Acme Thread tolerance.

Figure 9:
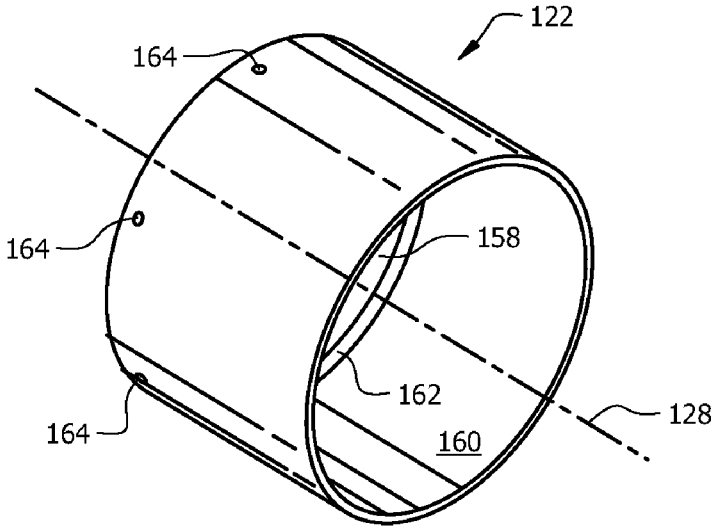
FIG. 9 is an oblique view of a retainer of the cement head of FIG. 1.
Figure 10:
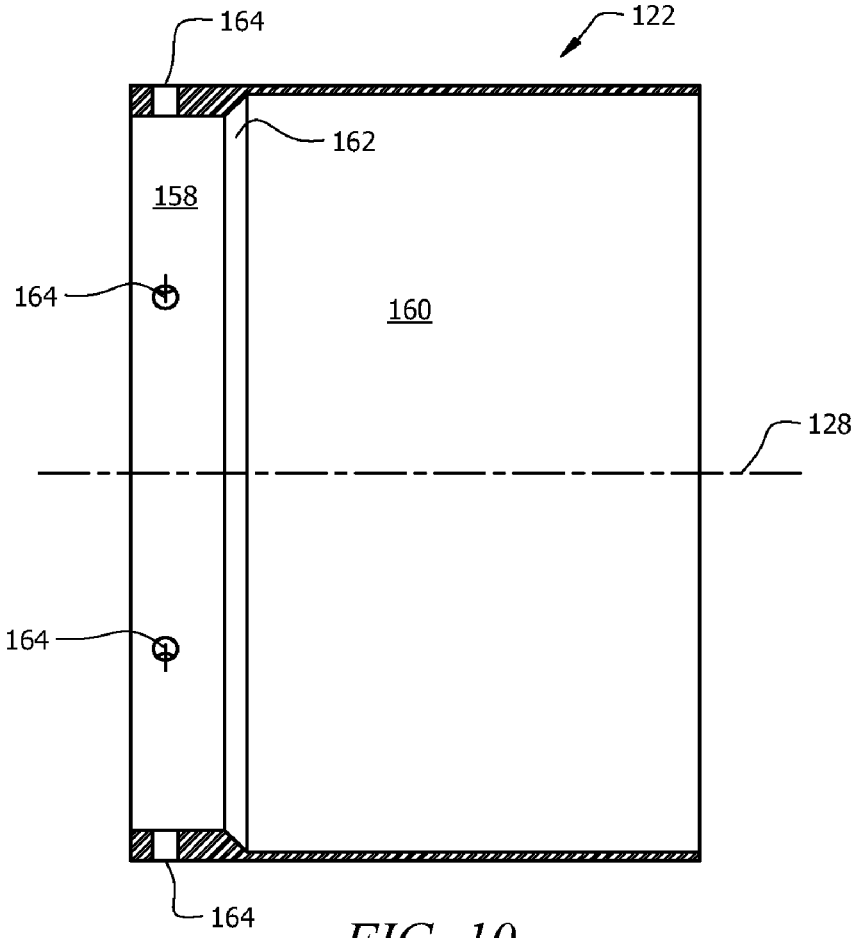
FIG. 10 is an orthogonal cross-sectional view of the retainer of FIG. 9.

Referring now to FIGS. 9 and 10 (and FIGS. 12 and 13), a retainer 122 is shown. The retainer 122 is formed substantially as a tubular cylindrical member having a cylindrical outer retainer surface. The interior of the retainer 122 substantially complements the combined shape of the exteriors of the bridges 118. In other words, the interior of the retainer 122 complements the combined profile of the outermost surface 150, reduced outer surface 152, and bevel 154 so that the two bridges 118, oriented as shown in FIGS. 6-8 with respect to each other, fit inside the retainer 122. More specifically, the retainer 122 comprises an innermost surface 158 connected to an enlarged inner surface 160 by a complementary bevel 162. When the cement head 100 is fully assembled as show in FIG. 1, the retainer 122 substantially surrounds the bridges 118 with the outermost surface 150 facing the enlarged inner surface 160, the reduced outer surface 152 facing the innermost surface 158, and with the complementary bevel 162 facing the bevel 154. The retainer further comprises retainer apertures 164 for receiving lock screws 126 therethrough.

Figure 11:
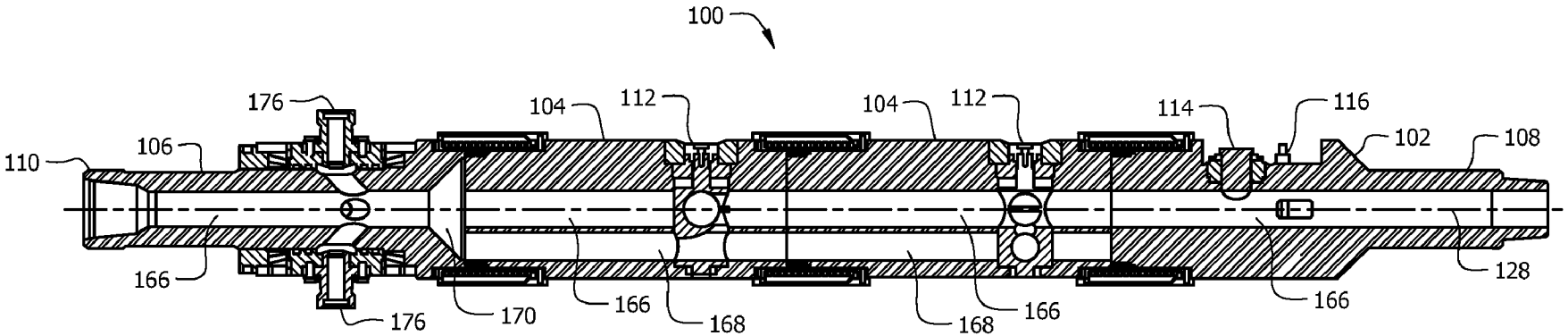
FIG. 11 is an orthogonal cross-sectional view of the cement head of FIG. 1.

Referring now to FIG. 11, a cross-sectional view of the cement head 100 in a fully assembled state is shown. This view is particularly useful in showing that cement head 100 comprises primary fluid flow bores 166 extending through each modules 102, 104, 106 along the central axis 128. Also well shown is that cement head 100 comprises bypass fluid flow bores 168 within each intermediate module 104. The input module 106 comprises a conical header 170 into which fluid is passed and from which each of the primary fluid flow bores 166 and bypass fluid flow bores 168 are in fluid communication with, depending on the operational positions of the launch valves 112. The bypass fluid flow path 168 generally begins at the interface between the input module 106 and the adjacent intermediate module 104 so that fluid exiting the input module 106 and entering the adjacent intermediate module 104 is capable of passing through either the primary fluid flow bore 166 or the bypass fluid flow bore 168, depending on the operational orientation of launch valves 112.

Assembly of the cement head 100 may be accomplished by performing the steps described below. First, the input module 106 is held in a vice or other gripping device. Next, and with reference to FIG. 12, a male tip 172 of an intermediate module 104 is inserted into a complementary female tip 174 of the input module 106 with seals 124 in place therebetween. While the seals 124 of this embodiment each comprise an elastomeric o-ring backed up with adjacent backup seals 125 (see FIGS. 3, 12, and 13) that are constructed of flouropolymer, in other embodiments, the seals may comprise any other suitable material or device. The backup seals 125 served to keep the seals 124 from extruding out of the space between the male tip 172 of the intermediate module 104 and the complementary female tip 174 of the input module 106 when the seals 124 are compressed. In alternative embodiments, the backup seals may be constructed of any other material to prevent the above-described extrusion. Next, keys 120 are inserted into slots 140 of the intermediate module 104 and the input module 106 with the slot contact surfaces 148 facing the central axis 128 and with one of the end blocks 142 substantially adjacent the full diameter section 134 of the intermediate module 104 while the other end block 142 is substantially adjacent the full diameter section 134 of the input module 106. Grease or similar substances may be used to temporarily hold the keys 120 in the slots 140. Next, the complementary profiles 132 of the bridges 118 are longitudinally aligned along the length of the central axis 128 with the respective primary outer profiles 130 of the input module 106 and adjacent connected intermediate module 104. After longitudinally aligning the complementary profiles 132 with the primary outer profiles 130, the bridges 118 are moved radially inward toward the central axis 128 to integrate the protrusions 138 with the complementary protrusions 156. Once the bridges 118 are in place and radially adjacent the input module 106 and the connected intermediate module 104, a retainer 122 is slid over the full diameter section 134 of the intermediate module 104 from the free end of the intermediate module and moved along the central axis 128 toward the input module 106 until the complementary bevel 162 is substantially adjacent the bevel 154. The connection between the input module 106 and the adjacent intermediate module 104 is completed by inserting lock screws 126 through the retainer apertures 164 that are not threaded and subsequently threading the lock screws 126 into the threads of the key apertures 146 of the keys 120.

Figure 13:
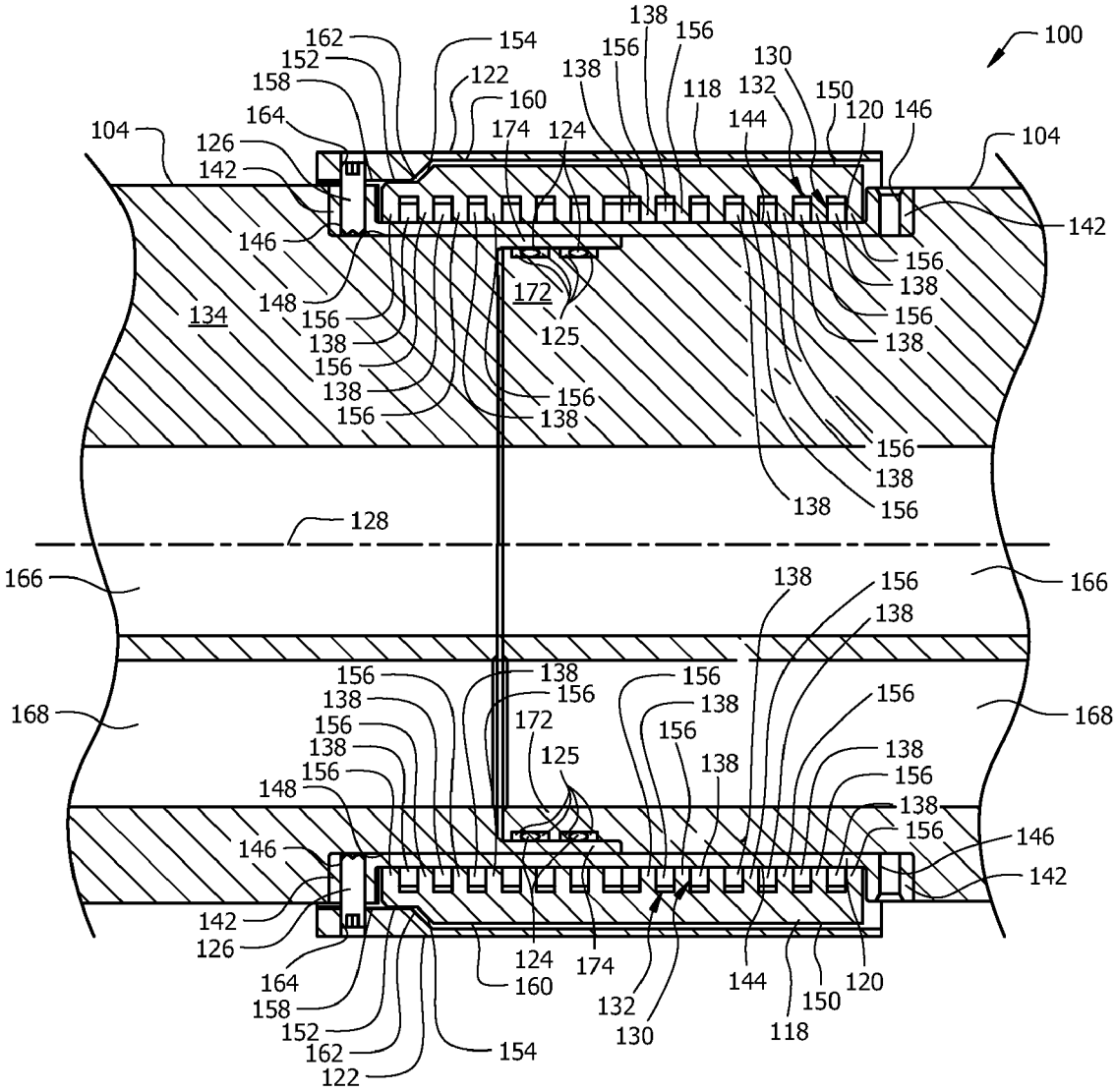
FIG. 13 is an orthogonal cross-sectional view of another portion of the cement head of FIG. 1.

Similar steps are taken to join the above-described intermediate module 104 that is connected to the input module 106 to another intermediate module 104. With reference to FIG. 13, a male tip 172 of another intermediate module 104 is inserted into a complementary female tip 174 of the intermediate module 104 that is connected to the input module 106, with seals 124 in place therebetween. Next, a retainer 122 is slid over the free end of the intermediate module 104 being added to the intermediate module 104 that is connected to the input module 106. The retainer 122 is moved along the central axis 128 toward the input module 106 until the retainer 122 interferes with the retainer 122 joining the input module 106 to the adjacent intermediate module 104. Next, keys 120 are inserted into slots 140 of the two adjacent intermediate modules 104 with the slot contact surfaces 148 facing the central axis 128 and with one of the end blocks 142 substantially adjacent the full diameter section 134 of one intermediate module 104 while the other end block 142 is substantially adjacent the full diameter section 134 of the other intermediate module 104. Grease or similar substances may be used to temporarily hold the keys 120 in the slots 140. Next, the complementary profiles 132 of the bridges 118 are longitudinally aligned along the length of the central axis 128 with the respective primary outer profiles 130 of the adjacent intermediate modules 104. After longitudinally aligning the complementary profiles 132 with the primary outer profiles 130, the bridges 118 are moved radially inward toward the central axis 128 to integrate the protrusions 138 with the complementary protrusions 156. Once the bridges 118 are in place and radially adjacent the adjacent intermediate modules 104, the retainer 122 is slid along the central axis 128 away from the input module 106 until the complementary bevel 162 is substantially adjacent the bevel 154. The connection between the two intermediate modules 104 is completed by inserting lock screws 126 through the retainer apertures 164 and subsequently threading the lock screws 126 into the threads of the key apertures 146 of the keys 120. It is important to note that in this connection between the two intermediate modules 104, the bevel 154 serves as a self-help safety insofar as the retainer 122 cannot slide so far along the central axis 128 that the complementary bevel 162 passes the bevel 154. In effect, the bevel 154 and the complementary bevel 162 act as safety stops for ensuring that the retainer 122 does not inadvertently discontinue holding bridges 118 in place.

Similar steps are taken to join the second joined intermediate module 104 to the output module 102. A male tip 172 of the output module 102 is inserted into a complementary female tip 174 of the second joined intermediate module 104, with seals 124 in place therebetween. Next, a retainer 122 is slid over the free end of the output module 102. The retainer 122 is moved along the central axis 128 toward the input module 106 until the retainer 122 interferes with the retainer 122 joining the two intermediate modules 104. Next, keys 120 are inserted into slots 140 of the second joined intermediate module 104 and the output module 102 with the slot contact surfaces 148 facing the central axis 128 and with one of the end blocks 142 substantially adjacent the full diameter section 134 of the second joined intermediate module 104 while the other end block 142 is substantially adjacent the full diameter section 134 of the output module 102. Grease or similar substances may be used to temporarily hold the keys 120 in the slots 140. Next, the complementary profiles 132 of the bridges 118 are longitudinally aligned along the length of the central axis 128 with the respective primary outer profiles 130 of the second joined intermediate module 104 and the output module 102. After longitudinally aligning the complementary profiles 132 with the primary outer profiles 130, the bridges 118 are moved radially inward toward the central axis 128 to integrate the protrusions 138 with the complementary protrusions 156. Once the bridges 118 are in place and radially adjacent the second joined intermediate module 104 and the output module 102, the retainer 122 is slid along the central axis 128 away from the input module 106 until the complementary bevel 162 is substantially adjacent the bevel 154. Here too, the bevel 154 and the complementary bevel 162 act as safety stops for ensuring that the retainer 122 does not inadvertently discontinue holding bridges 118 in place. The connection between the second joined intermediate module 104 and the output module 102 is completed by inserting lock screws 126 through the retainer apertures 164 and subsequently threading the lock screws 126 into the threads of the key apertures 146 of the keys 120. Performing the above assembly steps results in the cement head 100 being assembled as shown in FIG. 1. However, it will be appreciated that while two intermediate modules 104 are shown in the cement head 100, alternative embodiments of a cement head may comprise only one intermediate module or more than two intermediate modules, thereby allowing the selective creation of a cement head having the capability to scale up or down in the number of launch valves and object launch capability.

Once assembled as described above, the cement head 100 may be used to perform a variety of functions that are generally known in the art, some of which are describe here. Generally, flow through the cement head 100 would be from the left hand side of FIG. 11 to the right hand side of FIG. 11. When the cement head 100 is installed in a work string, the input module 106 is located higher than the output module 102 so that flow through the cement head 100 would be generally from top to bottom from the input module 106 to the output module 102. Flow through the cement head 100 enters either through the upper work string interface 110 or mixture ports 176, which are in fluid connection with the primary fluid flow bore 166 of the input module 106, and exits through the lower work string interface 108. The cement head 100 is capable of retaining and launching darts. Referring now to FIG. 11, the functionality of launch valves 112 is explained generally. Launch valves 112 operate in two positions. A first position is a bypass position where the launch valve prevents fluid flow directly through a primary fluid flow bore 166, but instead, allows fluid to flow from a bypass fluid flow bore 168 to a primary flow bore 166 on the downstream side of the launch valve 112. A second position is a primary position where the launch valve 112 allows fluid flow directly from a position upstream from the launch valve 112 in a primary fluid flow bore 166 to a position downstream from the launch valve 112 in a primary fluid flow bore 166. The primary position is a position in which a dart, ball, or other member to be launched is allowed to pass through the launch valve 112 from the upstream side of the launch valve 112 to the downstream side of the launch valve 112. Clearly, the launch valves 112 of FIG. 11 are positioned so that a dart, ball, or other member to be launched is free to pass through the downstream launch valve 112 (on the right side of the drawing). To aid in pushing the dart or other object through the downstream launch valve 112 (on the right side of the drawing), the upstream launch valve 112 is positioned in the bypass position so that fluid can flow from the bypass fluid flow bore 168 into the primary fluid flow bore 166 located upstream from the downstream launch valve 112. With the launch valves 112 in these positions, the upstream launch valve 112 could be holding a second dart or other object to be launched. With the downstream launch valve 112 in the primary position, the upstream launch valve 112 may be rotated one-quarter rotation from the bypass position to the primary position, thereby allowing passage of the dart and fluids through the primary fluid flow bores 166. Launch port 114 offers convenient access to a primary fluid flow bore 166 for allowing the insertion of a ball to be dropped through the primary fluid flow bore 166. Launch indicator 116 uses lever arms to interfere with balls and/or darts that pass by the launch indicator 116, resulting in a rotation of an indicator portion of the launch indicator 116 to signify whether a dart, ball, or other object has passed by the launch indicator 116. In this embodiment, no part of the launch valves 112 extend radially beyond the full diameter sections 134, thereby reducing the chance of inadvertently breaking portions of the launch valves 112. While not shown in this embodiment, alternative embodiments of a cement head may integrate a safety valve (i.e. a ball valve having a full bore inside diameter, sometimes referred to as a TIW or Texas Iron Works valve) into one or more of the input module, intermediate modules, and/or output module.

Figure 17:
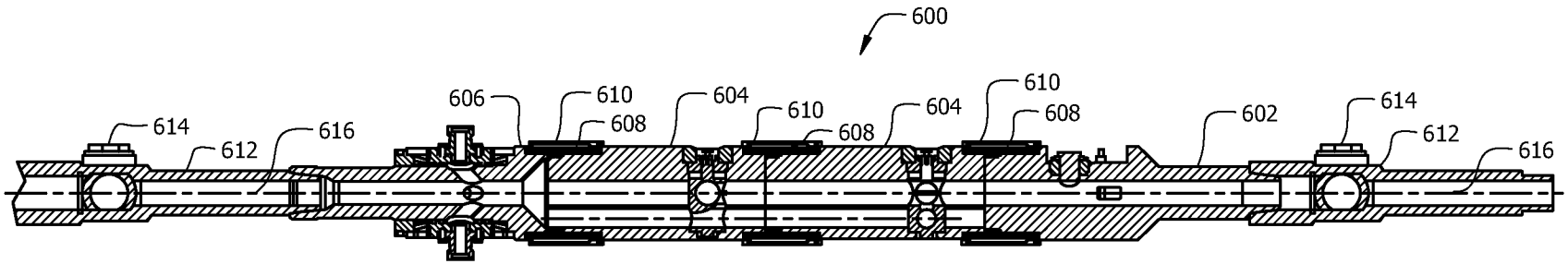
FIG. 17 is an orthogonal cross-sectional view of another alternative embodiment of a cement head comprising safety valves.

Such an alternative embodiment of a cement head comprising safety valves is shown in FIG. 17. The cement head 600 is substantially similar to cement head 100. Cement head 600 comprises an output module 602, intermediate modules 604, an input module 606, bridges 608, and retainers 610, each of which performs substantially the same function as the similarly named components of cement head 100. Cement head 600 further comprises safety modules 612. One safety module 612 is connected to the output module 602 while another safety module 612 is connected to the input module 606. The safety modules 612 are also connected to work string or other tools and selectively allow a fluid connection between the safety modules 612. Specifically, each safety module 612 comprises a safety valve 614 which is substantially configured as a ball valve that operates to selectively restrict fluid flow through the safety modules 612. The cement head 600 lies generally longitudinally along a central axis 616 in a manner substantially similar to the manner in which cement head 100 lies along central axis 128. In alternative embodiments, the safety valves could be configured as any other suitable valve.

Figure 14:
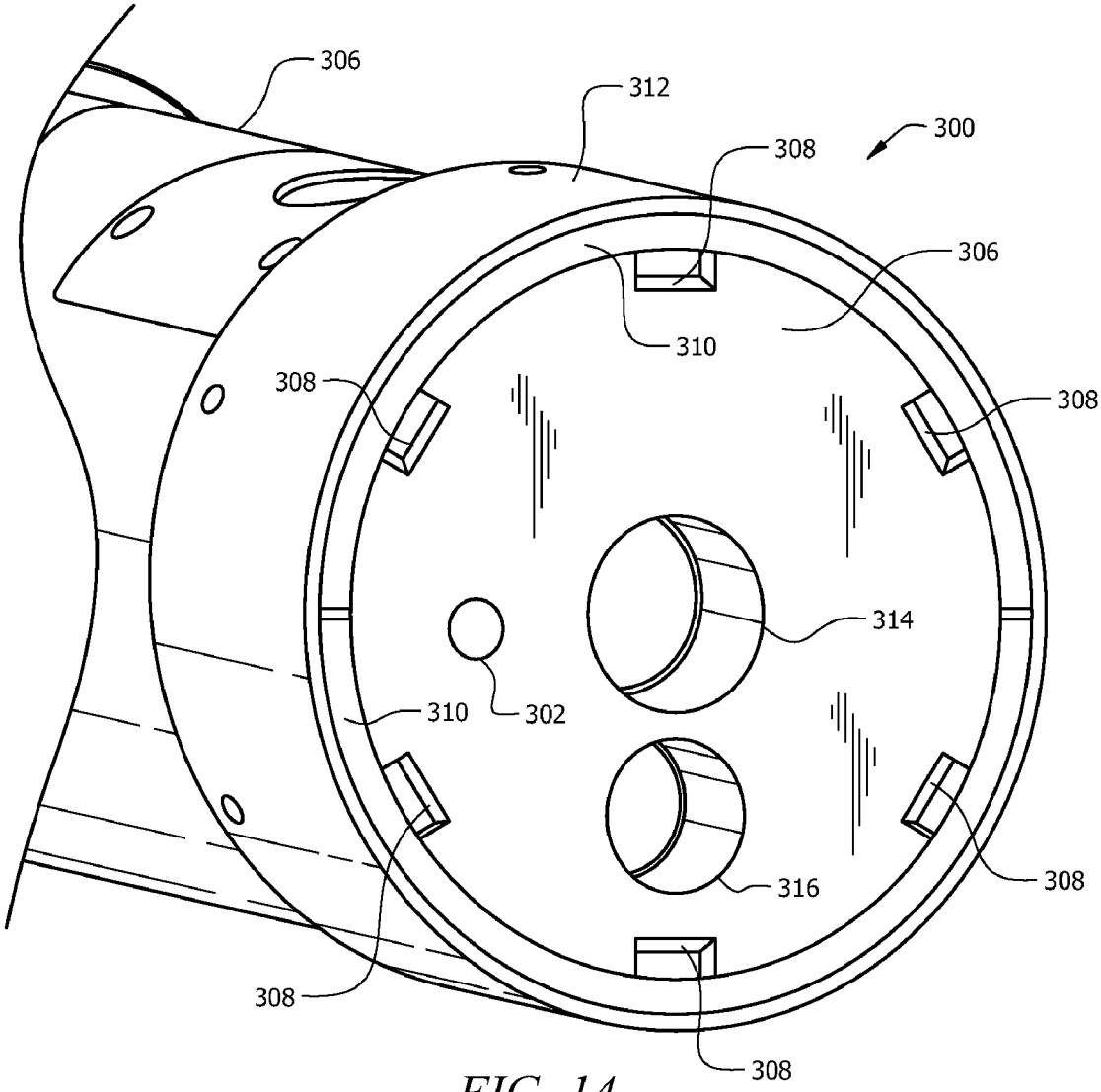
FIG. 14 is an oblique cross-sectional view of a portion of another alternative embodiment of a cement head.

Referring now to FIG. 14, in another alternative embodiment of a cement head 300, the cement head 300 comprises an internal control line 302 that extends at least through adjacent intermediate modules 306. In this embodiment, the internal control line 302 is well suited for communicating pneumatic control pressure/signals to launch valves substantially similar to launch valves 112, thereby allowing remote control of the launch valves. While only one internal control line 302 is shown, it should be understood that in alternative embodiments, additional control lines may be used to control additional launch valves, with at least one internal control line being associated with the control of each launch valve. Here again, by placing the internal control line 302 inside the cement head 300 rather than external to the modules, the chances for inadvertent damage to the internal control line 302 is minimized. Also shown are keys 308, bridges 310, retainer 312, primary fluid flow bore 314, and bypass fluid flow bore 316, each having substantially similar form and function to the like named parts of cement head 100.

Figure 15:
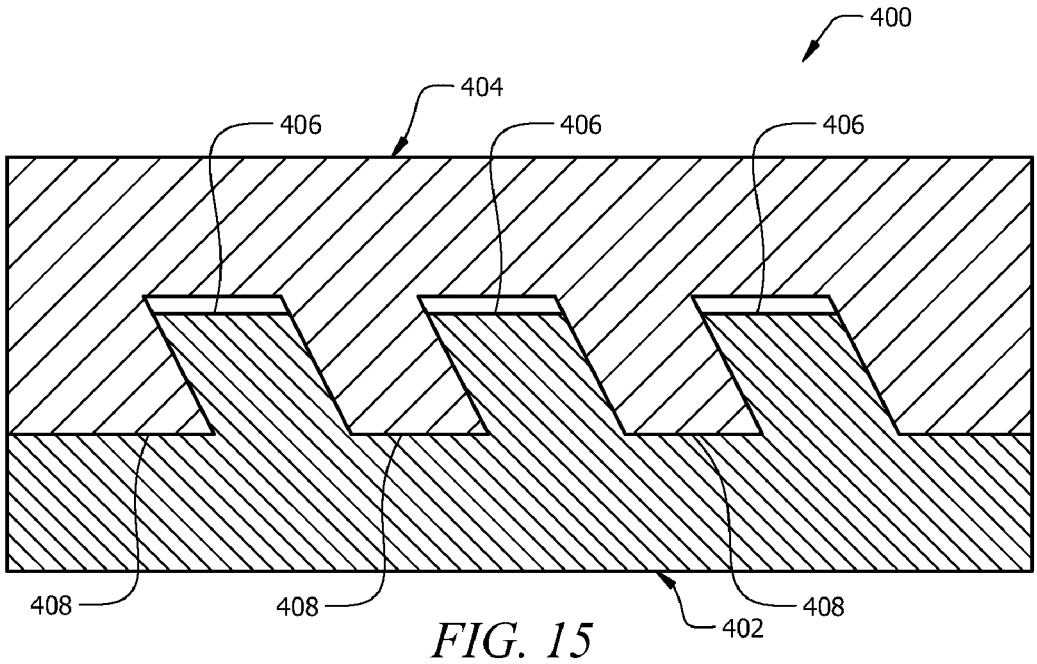
FIG. 15 is an orthogonal cross-sectional view of a portion of still another alternative embodiment of a cement head.

Referring now to FIG. 15, in still another alternative embodiment of a cement head 400, the cement head 400 comprises primary outer profiles 402 and complementary profiles 404 that serve substantially the same function as primary outer profiles 130 and complementary profiles 132, respectively. However, primary outer profiles 402 and complementary profiles 404 comprise angled protrusions 406 and angled complementary protrusions 408, respectively, rather than simple radially extending protrusions that substantially form a series of square grooves and/or square ridges. When oriented correctly, with the angled protrusions 406 being angled toward the upper work string interface, and with the angled complementary protrusion being complementary to the angled protrusions 406 yet angled away from the upper work string interface, a self-help interlocking between the angled protrusions 406 and the angled complementary protrusions 408 is accomplished. This self-help safety functionality is aided by gravity insofar as gravity pulls the complementary profiles 404 into full engagement with the primary outer profiles 402, thereby preventing inadvertent removal of the bridges that carry the complementary profiles 404 from the primary outer profiles 402 of the modules. In this embodiment, the assembly process requires that the step of radially moving the complementary profiles 404 into engagement with the primary outer profiles 402 be somewhat different from that of the similar step for assembly cement head 100. Namely, instead of only moving the complementary profiles 404 radially toward the primary outer profiles 402, the complementary profiles 404 must be moved simultaneously radially toward the primary outer profiles 402 and away from the upper work string interface along the central axis.

Figure 16:
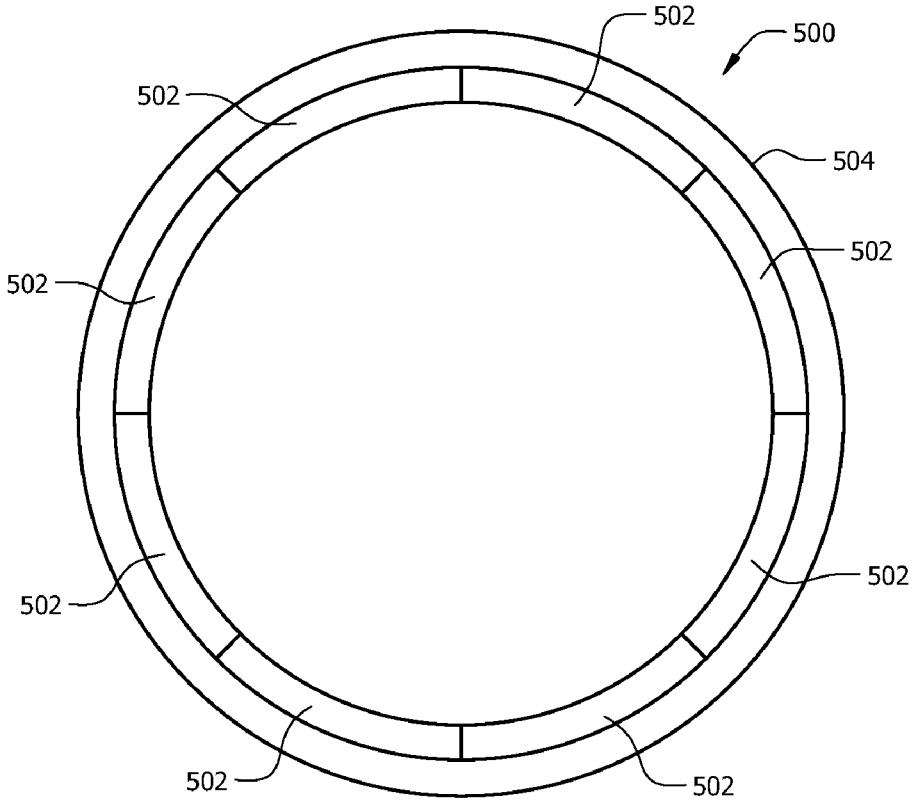
FIG. 16 is an orthogonal view of a portion of yet another alternative embodiment of a cement head.

Referring now to FIG. 16, in yet another alternative embodiment of a cement head 500, the cement head 500 comprises bridges 502 that are less than 180° segments of a cylindrical tubular ring. Specifically, in cement head 500, each connection between modules allows the use of eight bridges 502 rather than only two bridges 118 as required by cement head 100. In a substantially similar manner to that of cement head 100, the bridges 502 are held in place against the primary outer profiles using a retainer 504. While there are eight bridges 502, alternative embodiments of a cement head may comprise more or fewer than eight bridges. Further, in alternative embodiments of a cement head, the bridges may not be sized and/or there may not be enough bridges to, when the bridges are installed about the central axis, to substantially form a cylindrical tubular member. In other words, some embodiments of a cement head may comprise multiple bridges but with angular gaps (about the central axis) between the bridges.

Figure 18:
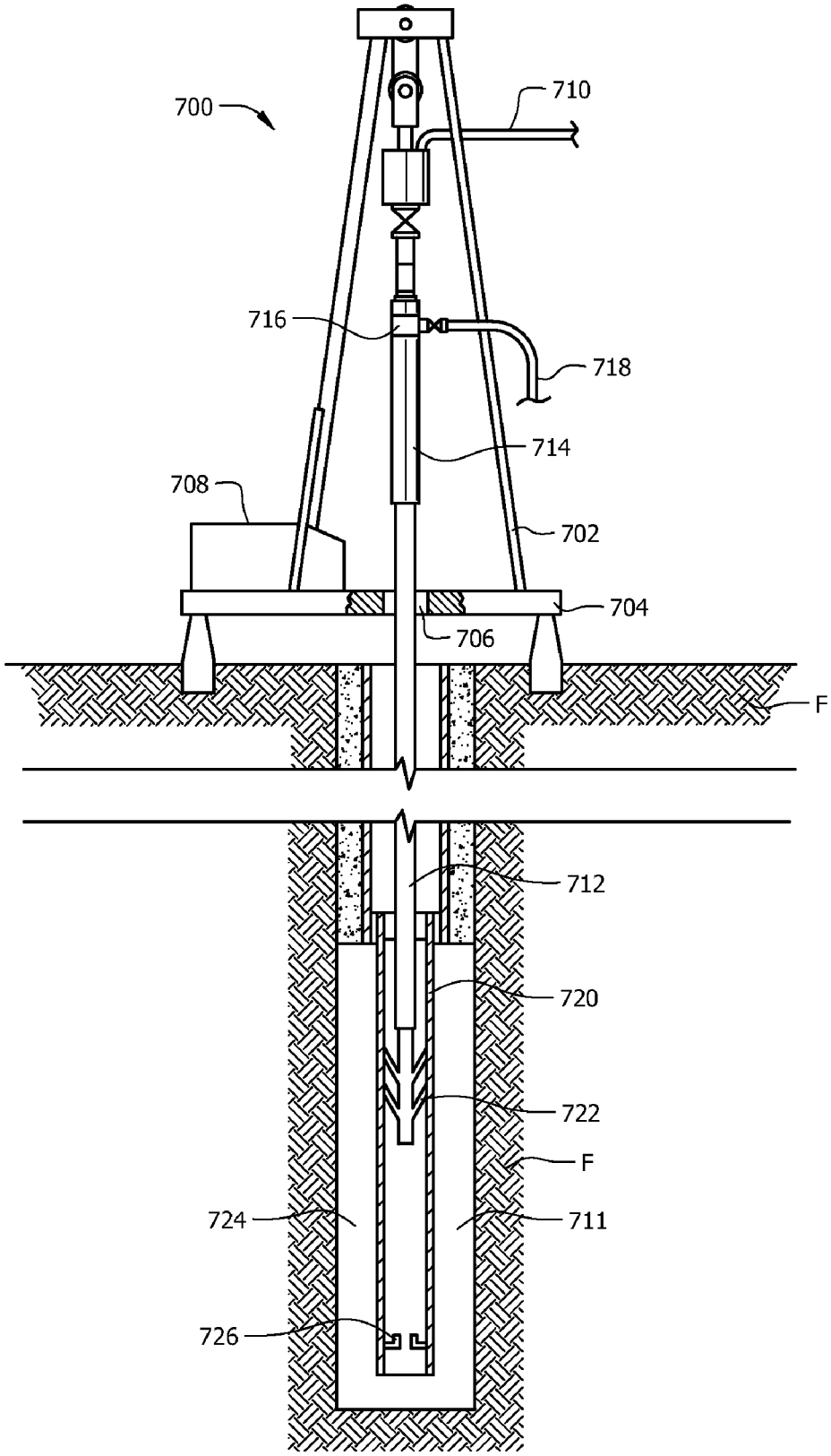
FIG. 18 is a schematic view of a drilling rig having an alternative embodiment of a cement head.

Referring now to FIG. 18, a drilling rig 700 at a wellsite is shown that comprises a derrick 702 having a rig floor 704 with a rig floor opening 706. A draw works 708 is used to control raising and lowering of components connected to a drilling fluid line 710 that feeds fluid to a drill string 712. The drill string 712 that extends through the rig floor opening 706 and into a wellbore 711 in a subterranean formation F. The drilling rig 700 further comprises a cement head 714 attached between and in fluid communication with the drilling fluid line 710 and the drill string 712. The cement head 714 is substantially similar in form and function to cement head 100, and selectively retains two darts 722 for performing a cementing job.

A method of servicing the wellbore 711 comprises locating the components of the cement head 714 near the wellsite, assembling the cement head 714 near the wellsite, and connecting cement head 714 in selective fluid communication between the drilling fluid line 710 and the drill string 712. Using valves similar to the valves of cement head 100, a cementing job comprises introducing cement into a swivel 716 of the cement head 714 from a cement supply line 718. The cement head 714 is operated to release a dart 722 coincident with the leading portion of cement so that the cement is segregated from other drilling fluids that may have previously been forced in a downhole direction. Once the desired amount of cement has been delivered through the cement head 714, a second dart 722 is released to closely follow the column of cement and thereby prevent mixing of the cement with drilling fluids that may be introduced after the introduction of the cement. The darts 722 also serve to wipe the interiors of the components through which they pass, thereby preventing cement buildup on those components. The cement column is forced down hole until the first dart is expelled through a landing collar 726 and the cement is forced into an annulus 724 between a tubular 720 and the formation F. Once the second dart 722 reaches the landing collar 726 the second dart 722 interferes with and serves to plug a hole in the landing collar 726. The cement is subsequently allowed to harden. It will be appreciated that assembly of the cement head 714 is substantially similar to the assembly of the cement head 100. It will further be appreciated that in an alternative embodiment, a portion or all of the cement head may be located lower toward the landing collar (or otherwise further downhole) than cement head 714 so that some portions of the cement head are bounded by the formation. Specifically, a portion or all of a cement head may be located below the rig floor.

It is important to note that while multiple embodiments of a cement head have been disclosed above, each of the cement heads offer a simple method of joining modules together without the need to apply a substantial amount of torque to any of the modules, bridges, or retainers. While the assembly process for each of the above-disclosed embodiments of a cement head may require simple angular orienting about the central axis and/or matching up of modules to be connected, no torque or rotational force beyond the torque necessary to overcome inertial forces related to the modules themselves is necessary to complete the process of connecting adjacent modules. It will further be appreciated that the type of connection between modules described above may also be extended into use for other well service tools and apparatuses. Specifically, equivalents to the primary outer profiles, complementary profiles, bridges, and retainers may be used to join any other suitable tool or apparatus while still achieving the benefits of low or no torque required to make the connection.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Accordingly, the scope of protection is not limited by the description set out above, but is defined by the claims which follow, that scope including all equivalents of the subject matter of the claims. Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings refer to a "Field of the Invention," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. The term "comprising" as used herein is to be construed broadly to mean including but not limited to, and in accordance with its typical usage in the patent context, is indicative of inclusion rather than limitation (such that other elements may also be present). In all instances, the scope of the claims shall be considered on their own merits in light of this disclosure, but should not be constrained by the headings set forth herein.

What is claimed is:

1. A cement head generally defining a primary flowbore and a bypass flowbore, the cement head comprising:

a first module comprising a first module outer profile;

a second module comprising a second module outer profile;

a bridge comprising a bridge profile engaged with each of the first module outer profile and the second module outer profile, wherein the bridge is configured to be engaged with the first module and the second module without application of torque to the bridge, the first module, or the second module;

a structural member disposed between the first module and the bridge, between the second module and the bride, or both and configured to transfer torque between the first module and the second module; and a launching valve, wherein the launching valve is selectively configurable in a bypass position or a primary position, wherein, when the launching valve is configured in the bypass position, the launching valve is configured to prevent fluid flow via the primary flowbore and to allow fluid flow via the bypass flowbore, and wherein, when the launching valve is configured in the primary position, the launching valve is configured to allow fluid flow via the primary flowbore.

2. The cement head according to claim 1, wherein the bridge transfers tensile forces between the first module and the second module.

3. The cement head according to claim 1, wherein the bridge profile complements each of the first module outer profile and the second module outer profile.

4. The cement head according to claim 1, wherein each of the first module outer profile, second module outer profile, and bridge profile generally lie along cylindrical surfaces.

5. The cement head according to claim 1, wherein each of the first module, the second module, and the bridge are substantially coaxial.

6. The cement head according to claim 1, wherein at least one of the first module outer profile, the second module outer profile, and the bridge profile comprises radial protrusions extending from a cylindrical surface.

7. The cement head according to claim 1, wherein at least one of the first module outer profile, the second module outer profile, and the bridge profile comprises an annular ring protruding from a cylindrical surface.

8. The cement head according to claim 1, wherein the bridge profile is constrained from disengaging from at least one of the first module outer profile and the second module outer profile.

9. The cement head according to claim 1, wherein the bridge is shaped substantially as an angular section of a cylindrical tube.

10. The cement head according to claim 9, further comprising:

a retainer that bounds an outer surface of the bridge.

11. The cement head according to claim 1, wherein the structural member comprises a key.

12. The cement head according to claim 11, wherein key comprises a threaded aperture configured to receive a lock screw.

13. The cement head according to claim 12, wherein a substantially cylindrical tubular retainer substantially covers the key but leaves the threaded aperture uncovered.

14. The cement head according to claim 1, wherein the structural member is received within the slot within the first module outer profile and within a slot within the second module outer profile.

15. The cement head according to claim 1, wherein each of the two or more bridges is shaped substantially as an angular section of a cylindrical tube.

16. A cement head, comprising:

a first module comprising a first module outer profile;

a second module comprising a second module outer profile; and a bridge comprising a bridge profile engaged with each of the first module outer profile and the second module outer profile, wherein the bridge is configured to be engaged with the first module and the second module without application of torque to the bridge, the first module, or the second module, wherein each of the first module and second module comprise a slot configured to receive a key and wherein the slot interferes with the first module outer profile and second module outer profile.

17. The cement head according to claim 16, wherein the key is configured to transfer torque between the first module and the second module.

18. The cement head according to claim 16, wherein the key comprises a threaded aperture configured to receive a lock screw.

19. The cement head according to claim 18, wherein a substantially cylindrical tubular retainer substantially covers the key but leaves the threaded aperture uncovered.

20. The cement head according to claim 16, wherein the bridge transfers tensile forces between the first module and the second module.

21. The cement head according to claim 16, wherein the bridge profile complements each of the first module outer profile and the second module outer profile.

22. The cement head according to claim 16, wherein each of the first module outer profile, second module outer profile, and bridge profile generally lie along cylindrical surfaces.

23. The cement head according to claim 16, wherein each of the first module, the second module, and the bridge are substantially coaxial.

24. The cement head according to claim 16, wherein at least one of the first module outer profile, the second module outer profile, and the bridge profile comprises radial protrusions extending from a cylindrical surface.

25. The cement head according to claim 16, wherein at least one of the first module outer profile, the second module outer profile, and the bridge profile comprises an annular ring protruding from a cylindrical surface.

26. The cement head according to claim 16, wherein the bridge profile is constrained from disengaging from at least one of the first module outer profile and the second module outer profile.

27. The cement head according to claim 16, wherein the bridge is shaped substantially as an angular section of a cylindrical tube.

28. A cement head generally defining a primary flowbore and a bypass flowbore, the cement head, the cement head comprising:

a first module coaxial with a central axis, the first module comprising:

a first module outer surface;

a first slot disposed on the first module outer surface; and a plurality of first module protrusions extending radially outward from the first module outer surface;

a second module coaxial with the central axis, the second module comprising:

a second module outer surface;

a second slot disposed on the second module outer surface; and a plurality of second module protrusions extending radially outward from the second module outer surface;

a key engaging the first slot and the second slot, wherein the key is configured to transfer torque between the first module and the second module;

two or more bridges, each of the two or more bridges comprising a radial portion of a generally cylindrical tube, the two or more bridges together forming the cylindrical tube, and each of the two or more bridges having an outer bridge surface and an inner bridge surface, the bridge inner surfaces substantially complementing each of the first module outer surface, including the plurality of first module projections, and the second module outer surface, including the plurality of second module projections, when the first module is substantially adjacent the second module and a bridge outer surface;

a retainer coaxial with the central axis and configured to substantially radially retain the two or more bridges toward the central axis with respect to each of the first module outer surface and the second module outer surface; and a launching valve, wherein the launching valve is selectively configurable in a bypass position or a primary position, wherein, when the launching valve is configured in the bypass position, the launching valve is configured to prevent fluid flow via the primary flowbore and to allow fluid flow via the bypass flowbore, and wherein, when the launching valve is configured in the primary position, the launching valve is configured to allow fluid flow via the primary flowbore.

29. The cement head according to claim 28, wherein the two or more bridges transfer tensile forces between the first module and the second module.

30. The cement head according to claim 28, wherein each of the first module outer surface, second module outer surface, and bridge inner surfaces generally lie along cylindrical surfaces.

31. The cement head according to claim 28, wherein each of the first module, the second module, and the two or more bridges are substantially coaxial.

32. The cement head according to claim 28, wherein at least one of the first module outer surface, the second module outer surface, and the bridge inner surface comprises radial protrusions extending from a cylindrical surface.

33. The cement head according to claim 28, wherein the two or more bridges are constrained from disengaging from at least one of the first module outer surface and the second module outer surface.

* * * * *